US006454029B1

(12) United States Patent
Loots et al.

(10) Patent No.: US 6,454,029 B1
(45) Date of Patent: Sep. 24, 2002

(54) ROTARY BORING BIT AND BORER

(76) Inventors: Danie Johannes Loots, Parry Road, Nuffield, Springs (ZA), 1559; Dermot Clement Stobart, Parry Road, Nuffield, Springs (ZA), 1559

( * ) Notice: Subject to any disclaimer, the term of this patent is extended or adjusted under 35 U.S.C. 154(b) by 15 days.

(21) Appl. No.: 09/721,985

(22) Filed: Nov. 27, 2000

(30) Foreign Application Priority Data

Nov. 26, 1999 (ZA) ..... 99/7333

(51) Int. Cl.[7] ..... E21B 10/40
(52) U.S. Cl. ..... 175/420.1; 175/421
(58) Field of Search ..... 175/351, 390, 175/395, 397, 401, 420.1, 421

(56) References Cited

U.S. PATENT DOCUMENTS

| | | | | | |
|---|---|---|---|---|---|
| 1,318,940 | A | * | 10/1919 | Williams | 175/401 |
| 1,845,061 | A | * | 2/1932 | Schmalz | 175/421 |
| 2,614,814 | A | * | 10/1952 | Jones et al. | 175/421 |
| 2,740,611 | A | * | 4/1956 | Bowen | 175/421 |
| 3,595,327 | A | | 7/1971 | Self | |
| 4,143,723 | A | * | 3/1979 | Schmotzer | 175/420.1 |
| 4,342,368 | A | * | 8/1982 | Denman | 175/420.1 |
| 4,595,322 | A | * | 6/1986 | Clement | 175/420.1 |
| 5,172,775 | A | | 12/1992 | Sheirer et al. | |
| 5,383,526 | A | | 1/1995 | Brady | |
| 5,735,648 | A | | 4/1998 | Kleine | |
| 5,829,540 | A | | 11/1998 | Peay et al. | |

FOREIGN PATENT DOCUMENTS

| | | | |
|---|---|---|---|
| DE | 801327 | * | 7/1949 |
| DE | 2756990 | * | 6/1979 |
| GB | 832238 | | 4/1960 |
| GB | 1062158 | | 3/1963 |

* cited by examiner

*Primary Examiner*—Frank Tsay
(74) *Attorney, Agent, or Firm*—Roylance, Abrams, Berdo & Goodman, L.L.P.

(57) ABSTRACT

The invention concerns a rotary boring bit, typically for coal drilling applications. The bit (10) of the invention is in the form of a hardmetal blade and includes a cutting edge (18) having an outwardly projecting gable shaped cutting formation on either side of the intended axis of rotation (A). The bit has parallel side edges (14 and 16) which extend between the cutting edge (18) and the base of the bit. In the preferred bit, the apices of the cutting formations lie in a common plane normal to the axis of rotation (A) but are unequally spaced from the axis.

16 Claims, 1 Drawing Sheet

ROTARY BORING BIT AND BORER

BACKGROUND TO THE INVENTION

THIS invention relates to a rotary boring bit and to a rotary borer incorporating the bit.

Rotary coal borers are used to drill holes in coal mines. The holes may be in the roof, to be used for roof bolting to support the roof, or they may be used for drilling blast holes in the coal body itself. A common form of coal boring bit or insert is made from or includes hardmetal such as cemented tungsten carbide. The bit is in the form of a generally rectangular blade with one of its long edges being upwardly inclined from its short edges to provide a gabled cutting edge with the apex of the cutting edge being in register with the axis of rotation of the steel borer body. The bit is partially embedded in the body and is generally fixed to it by brazing with its cutting edge standing proud of the borer body material in the drilling direction of the borer.

In addition to the cutting edge, the side edges on known bits project radially from the borer body and have what is known as a clearance angle on the body gauge which is intended to minimize jamming of the borer during drilling.

The bit of a borer of the above type rotates during drilling on a pressure point at the apex of the cutting edge, with little cutting action taking place at that point. This inhibits the penetration rate of the borer. A further disadvantage of the known borers is that the clearance tapers of the side edges significantly reduce the length of the reaming edges of the bit and so reduce the resistance of these short edges to wear. As a result the borers can become under gauge prematurely and have to be discarded at an early stage.

SUMMARY OF THE INVENTION

According to one aspect of the invention there is provided a rotary boring bit, typically for coal drilling applications, which is in the form of a hardmetal blade and which includes a cutting edge having an outwardly projecting gable shaped cutting formation on either side of the intended axis of rotation of the blade, a base which is spaced on the axis from the cutting edge and parallel side edges which extend between the cutting edge and base.

For improved penetration rates, it is preferred that the gable shaped cutting formations have apices which are unequally spaced from the axis of rotation of the bit, and that the sloping gable side edges be inclined at an angle in the range 30° to 34°, preferably about 32°, relative to a plane normal to the axis of rotation of the bit. The apices may however lie in a common plane normal to the axis of rotation of the bit.

The cutting edge of the bit may be sharpened, typically at an angle of about 17° to a plane normal to the axis of rotation, in opposite directions on opposite sides of the axis of rotation of the bit. Sharpening may take place, on each side of the axis of rotation of the bit, in a direction away from the direction of movement of that side during rotary drilling. Similarly, the parallel side edges of the bit may be sharpened in opposite directions, with each side once again being sharpened in a direction away from the direction of movement of that side during rotary drilling.

According to another aspect of the invention there is provided a rotary borer comprising a substantially cylindrical body and a bit, as summarised above, fixed diametrically in the body with its cutting edge projecting from the body in the drilling direction of the borer and its side edges projecting radially from the side of the body.

BRIEF DESCRIPTION OF THE DRAWINGS

The invention will now be described in more detail, by way of example only, with reference to the accompanying drawings in which.

DESCRIPTION OF A PREFERRED EMBODIMENTS

Figure 1:
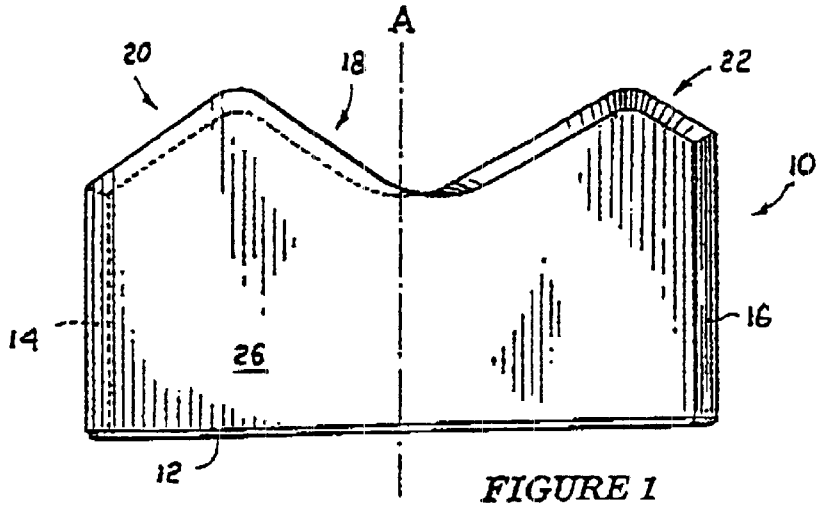
FIG. 1 shows a front elevation of a boring bit according to the invention.

The illustrated boring bit 10 is blade-shaped and is made from a hardmetal, such as cemented tungsten carbide, conventionally used in the manufacture of drill bits of this general type. It includes a base 12, side edges 14 and 16 and a cutting edge 18. The side edges 14 and 16 are parallel to each other and to the axis of rotation A of the bit in use. The cutting edge 18 is generally sinusoidal in shape and includes two gable shaped cutting formations 20 and 22, the apices of which are spaced from the axis A by different distances.

Figure 2:
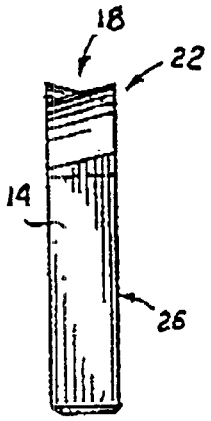
FIG. 2 shows a slide elevation of the bit seen in FIG. 1.
Figure 3:
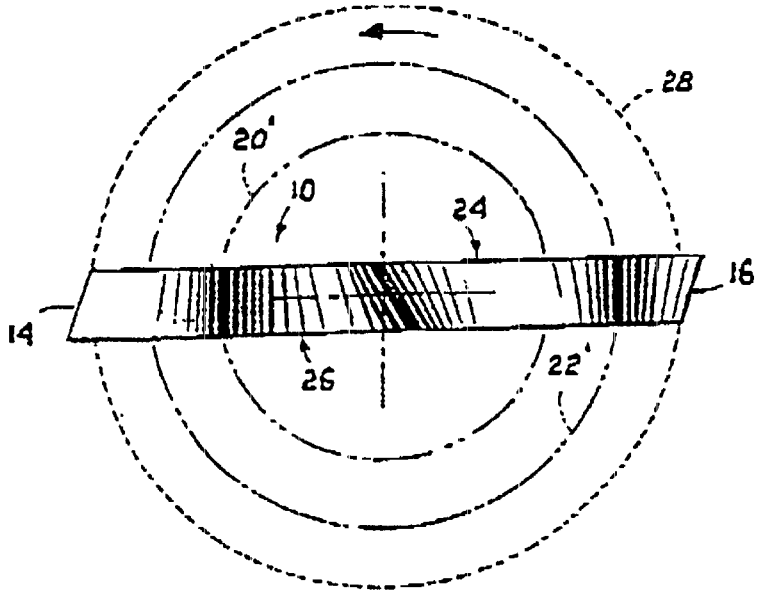
FIG. 3 shows a plan view of the bit which is mounted in a diagrammatically illustrated borer body.

The bit is intended for rotation in a counter-clockwise direction as illustrated by the arrow in FIG. 3. As shown in FIG. 2, the cutting edge 18 is sharpened away from the attacking faces 24 and 26 of the bit at an angle of about 17° to a plane normal to the axis A.

The apices of the cutting edge gables lie in a common plane which is normal to the axis A. The sloping side edges of the gables are inclined at an angle of about 32° to the hypothetical plane normal to the axis A.

Like the cutting edge 18 the side edges 14 and 16 are sharpened away from the attacking faces 24 and 26 of the bit, as shown in FIG. 3.

The bit 10 is shown in FIG. 3 to be located in a borer body 28 with the cutting edge 18 projecting from the material of the body in the drilling direction of the borer. The side edges 14 and 16 of the bit, which serve a hole reaming function in use, project from the side of the body over their entire length.

In use, with the bit 10 rotating about its axis A, the apices of the gable shaped cutting formations 20 and 22 rotate about the axis A on different, concentric cutting paths 20' and 22', as shown in FIG. 3. This is considered to be an important feature of the invention which can considerably improve the penetration rate of the borer. Whereas a conventional bit as described previously performs essentially a grinding action to penetrate the rock, the offset apices of the present embodiment can be expected can be expected to break the rock into small fragments or chips.

The fact that the side edges 14 and 16 of the bit perform a reaming action over their entire lengths is also considered to be an advantage of the illustrated embodiment which can improve the consistency of the hole diameter compared to known bits with tapering side edges. A consistent hole diameter is particularly important in the installation and anchoring of roof bolts.

Furthermore, the non-tapering configuration of the side edges 14 and 16 results in there being a greater amount of hardmetal cutting material at the gauge of the bit than in bits with side edge clearance tapers. Because there is therefore more hardmetal available for wear, this feature can be expected to increase the service life of the bit and borer.

We claim:

1. A rotary boring bit in the from of a hardmetal blade, comprising:

a cutting edge having outwardly projecting gable shaped cutting formations on sides of an intended axis of rotation of the bit, the cutting edge being generally sinusoidal in shape, the gable shaped cutting formations having apices unequally spaced from the axis of rotation of the bit and lying in a common plane normal to the axis of rotation of the bit;

a base spaced on the axis from the cutting edge; and parallel side edges extending between the cutting edge and base.

2. A bit according to claim 1 wherein the gable shaped cutting formations have sloping side edges inclined at an angle in the range 30° to 34° relative to a plane normal to the axis of rotation of the bit.

3. A bit according to claim 2 wherein the sloping side edges of the gable shaped formations are inclined at an angle of about 32° relative to a plane normal to the axis of rotation of the bit.

4. A bit according to claim 3 wherein the cutting edge of the bit is sharpened in opposite directions on opposite sides of the axis of rotation of the bit.

5. A bit according to claim 4 wherein the cutting edge is sharpened at an angle of about 17° relative to a plane normal to the axis of rotation of the bit.

6. A bit according to claim 5 wherein the cutting edge is sharpened, on each side of the axis or rotation of the bit, in a direction away from the direction of movement of that side during rotary drilling.

7. A bit according to claim 3 wherein the parallel side edges of the bit are sharpened in opposite directions.

8. A bit according to claim 7 wherein each side is sharpened in a direction away from the direction of movement of that side during rotary drilling.

9. A rotary borer for drilling a hole in a drilling direction, the borer comprising:

a substantially cylindrical body having a central axis about which the body is rotated in use; and a rotary boring bit, in the form of a hardmetal blade, fixed diametrically in the body, the bit including a cutting edge projecting from the body in the drilling direction and having outwardly projecting gable shaped cutting formations on sides of the central axis, a base spaced on the central axis from the cutting edge and parallel side edges extending between the cutting edge and the base and projecting radially from the body, the cutting edge being generally sinusoidal in shape, the gable shaped cutting formations having apices unequally spaced from the central axis and lying in a common plane normal to the central axis.

10. A borer according to claim 9 wherein the gable shaped cutting formations have sloping side edges inclined at an angle in the range 30° to 34° relative to a plane normal to the central axis.

11. A borer according to claim 10 wherein the sloping side edges of the gable shaped formations are inclined at an angle of about 32° relative to a plane normal to the central axis.

12. A borer according to claim 11 wherein the cutting edge of the bit is sharpened in opposite directions on opposite sides of the central axis.

13. A borer according to claim 12 wherein the cutting edge is sharpened at an angle of about 17° relative to a plane normal to the central axis.

14. A borer according to claim 13 wherein the cutting edge is sharpened, on each side of the central axis, in a direction away from a direction of movement of that side during rotary drilling.

15. A borer according to claim 11 wherein the parallel side edges of the bit are sharpened in opposite directions.

16. A borer according to claim 15 wherein each side edge of the bit is sharpened in a direction away from the direction of movement of that side during rotary drilling.

* * * * *